United States Patent [19]

Watters et al.

[11] 4,059,726

[45] Nov. 22, 1977

[54] PROCESS AND APPARATUS FOR SPEECH PRIVACY IMPROVEMENT THROUGH INCOHERENT MASKING NOISE SOUND GENERATION IN OPEN-PLAN OFFICE SPACES AND THE LIKE

[75] Inventors: Bill G. Watters, Gloucester; Michael Nacey, Belmont; Thomas R. Horrall, Harvard, all of Mass.

[73] Assignee: Bolt Beranek and Newman, Inc., Cambridge, Mass.

[21] Appl. No.: 697,562

[22] Filed: June 18, 1976

Related U.S. Application Data

[63] Continuation of Ser. No. 527,941, Nov. 29, 1974, abandoned.

[51] Int. Cl.[2] ..... H04K 1/00

[52] U.S. Cl. ..... 179/1.5 M; 179/1 AA; 179/1 P

[58] Field of Search ..... 179/1 AA, 1 AT, 1.5 R, 179/1.5 M, 2.5 R

[56] References Cited

U.S. PATENT DOCUMENTS

| | | | |
|---|---|---|---|
| 3,213,851 | 10/1965 | Currea | 179/1 AA |
| 3,272,198 | 9/1966 | Balkin | 179/1 AA |
| 3,400,221 | 9/1968 | Wolters | 179/2.5 R |
| 3,567,863 | 3/1971 | Morrissey | 179/1 AA |
| 3,909,618 | 9/1975 | Fujii | 179/2.5 R |

*Primary Examiner*—William C. Cooper
*Assistant Examiner*—E. S. Kemeny
*Attorney, Agent, or Firm*—Rines and Rines, Shapiro and Shapiro

[57] ABSTRACT

The invention involves the use of a plurality of incoherent noise generators distributed, in one embodiment, along ceilings in open-plan and partitioned office spaces and the like, to diffuse masking sound energy through acoustical tile and other false ceiling structures while tailoring the same for speech privacy results, by providing a uniform, delocalized and incoherent masking sound space.

14 Claims, 4 Drawing Figures

PROCESS AND APPARATUS FOR SPEECH PRIVACY IMPROVEMENT THROUGH INCOHERENT MASKING NOISE SOUND GENERATION IN OPEN-PLAN OFFICE SPACES AND THE LIKE

This is a continuation of application Ser. No. 527,941, filed Nov. 29, 1974 now abandoned.

The present invention relates to sound diffusers for ceilings and similar surfaces, being more particularly directed to providing masking noise distribution in open-plan landscaped and partitioned office spaces and the like to improve speech privacy and for related results.

The problem underlying the preferred application of the invention is to provide throughout open-plan offices, rooms, working spaces and the like, where usually privacy is provided by partial screens and similar devices, but wherein sound can flow between spaces, a spacially uniform masking noise of non-obtrusive, pleasant acoustic quality, tailored to be effective in masking speech sounds and the like at a minimum of cost. Open-plan spaces are described, for example, in "The Private Office" by Ziering, TWA Ambassadors Magazine, May 12, 1973, p. 12. It has been found that a reasonable degree of acoustic privacy can be obtained with high enough intensity background noise, but of unobtrusive character and of frequency spectrum, tailored preferably to resemble wind or waves, as described, for example, on p. 592 et seq. of "Noise and Vibration Control", Leo L. Beranek, McGraw Hill, 1971. It is believed that such a spectrum preferably has the following relative approximate levels, measured in octave bands: 125 Hz-0db; 250 Hz-3db; 500 Hz-6db; 1000 Hz-11db; 2000 Hz-18db; 4000 Hz-26db; 8000 Hz-36db. The extent to which the listener localizes the source, of course, is a measure of the obtrusive character of the installation.

Prior approaches to the solution of this problem include a noise-propagating array of loudspeakers above the acoustical tiles in a hung acoustical ceiling. (See, for example, "Speech Privacy In Buildings", Journal of the Acoustical Society of America, Vol. 34, p. 475–492, 1962). Since the acoustical transmission loss factors of such ceilings in different buildings widely vary, the electronic system must be tuned to provide the desired spectrum. Obstructions and duct work, moreover, can produce non-uniform spacial masking sound distribution. Conventional systems for masking purposes in large open plan spaces, indeed, customarily employ a centrally located electronic noise generating and amplifying assembly, a complex loudspeaker transducer power distribution network, and a multiplicity of loudspeakers operating in total or partial acoustical phase coherence and distributed spatially throughout the area of coverage, as described, for example, in the "Privatalk" catalog of Baldwin-Ehret-Hill, Inc., 1973. The coherence resulting from such speakers connected to the same sound amplifier or other source often creates an undesirable sound-shifting sensation in moving about the space, requiring a plurality of separate distribution systems and incoherent sources, increasing both complexity and cost. Such installations, moreover, require licensed and skilled installers from other trades than the building construction trades per se.

Other approaches have involved the use of aerodynamically driven noise sources connected by flexible tubing to a constant pressure air supply source, but again requiring special equipment in the form of an air supply source and distribution system.

If, moreover, resort is had to the masking noise of the ventilating, heating, or air conditioning system itself, the variations in the ventilating system cause non-uniformity of masking noise and its distribution; and usually uniform distribution is not feasible with the positions selected for such systems.

In accordance with the present invention, on the other hand, such difficulties are admirably overcome, in summary, by appropriately employing a plurality of self-contained and independent electronic noise generator units each comprising a noise source, frequency shaper, amplifier and loudspeaker transducer radiator, with the separate units distributed, in a preferred embodiment of the invention, along the ceiling throughout the space, to provide the desired spacially uniform sound distribution. In such preferred realization, the invention employs a regular pattern of such generator units concealed above acoustical tile ceiling in appropriate position and distribution, with primary power derived from a dedicated power distribution system or from a power distribution system intended for other above-ceiling components, such as for lighting fixtures. Maximum delocalization of the sound is achieved as a result of these independent sources, taking advantage of the characteristics of the ceiling structure for more uniform distribution of the masking sound. Other distributed installations are also feasible, as later explained.

In prior art systems, moreover, with loudspeakers disposed above the ceilings to try to reduce localization, the variability in the components in the plenum above the ceiling in the different parts of the building produces tonal variations in the space below obviated by the present invention.

In accordance with the invention, moreover, the radiated power level of each unit (1) is independent of components or variable characteristics of the plenum, (2) is easily separately adjustable, and (3) either directly faces into the room or reflects from the main ceiling into the room, but with the added automatic distributing and appearance-hiding features of the visible ceiling.

An object of the invention, accordingly, is to provide such a new and improved process and apparatus for masking noise distribution, particularly in open-plan partially partitioned spaces and the like.

A further object is to provide a novel masking noise-speech privacy process and apparatus.

Still another object is to provide an improved sound distribution process and apparatus of more general utility, as well, together with the flexibility for superimposing coherent intelligence, at will, such as speech messages, music and the like.

Other and further objects will appear hereinafter and are more particularly pointed out in the appended claims.

The invention will now be described with reference to the accompanying drawing,

FIG. 1 of which is a functional block diagram of a preferred noise generator unit useful with the invention;

Figure 1:
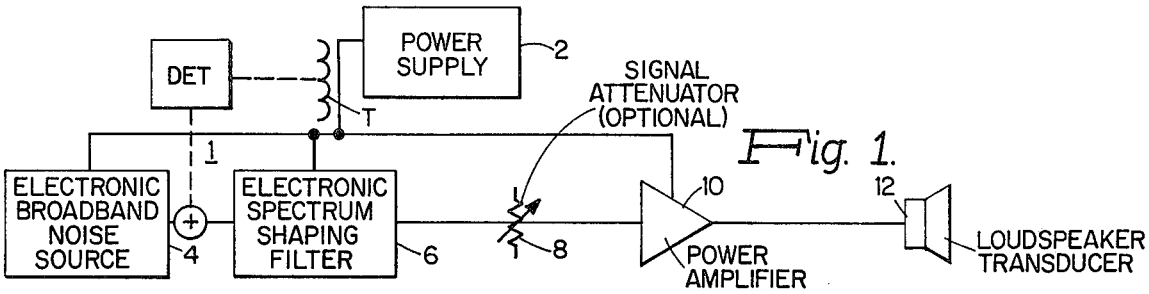
FIG. 1A is a similar diagram of a transmitter for superimposing upon the masking noise, if desired, coherent intelligence such as speech messages and/or background music or other signals.

Each of the independent self-contained noise generator units of the invention may be of the form functionally illustrated in FIG. 1, embodying in a single housing, generally designated at 1, a broadband electronic noise source 4 the output of which is appropriately frequency-shaped, as before and hereinafter described, in a tunable filter 6, with the appropriately frequency-tailored noise spectrum signal amplitude-adjusted by an attenuator 8 and then amplified at 10 and radiated by a loudspeaker 12. The unit, as previously explained, may be powered at 2, FIGS. 1 and 2, from the same power conduits provided for the lighting or other ceiling electric equipment.

Figure 2:
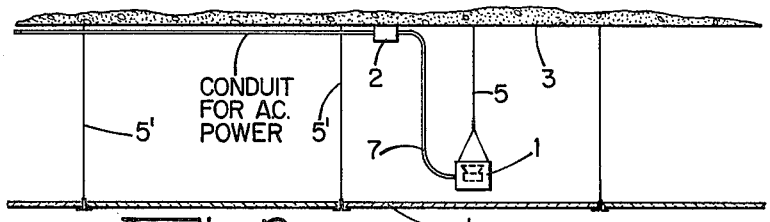
FIG. 2 is a longitudinal section illustrating a method of mounting the units.

As more particularly shown in FIG. 2, the masking generator unit 1 is mountable at variable distances from the main ceiling 3, as by a suspension 5 (which may include the power cord 7), or by mounting brackets (not shown) connected with conduit junction boxes and the like carried by or from the main ceiling 3. The speaker may point downward or upward, as shown, as desired. Thus control is effected of the position or region of disposition of the unit housing 1 within the air space between the main ceiling and the sound-transmitting acoustical or other false ceiling surface 3′ suspended by struts 5′ or otherwise from the main ceiling 3. In this manner, the installation can be effected by the same personnel who install other ceiling structures and from the same power outlets, with flexibility for taking advantage of the frequency-tailoring, final-attenuation adjustment and diffusing characteristics of the particular acoustical or other visible ceiling surface 3′ or other diffuser at the top of the open space and which serves to transmit the masking noise from the generator units 1 into the open space below.

Figure 3:
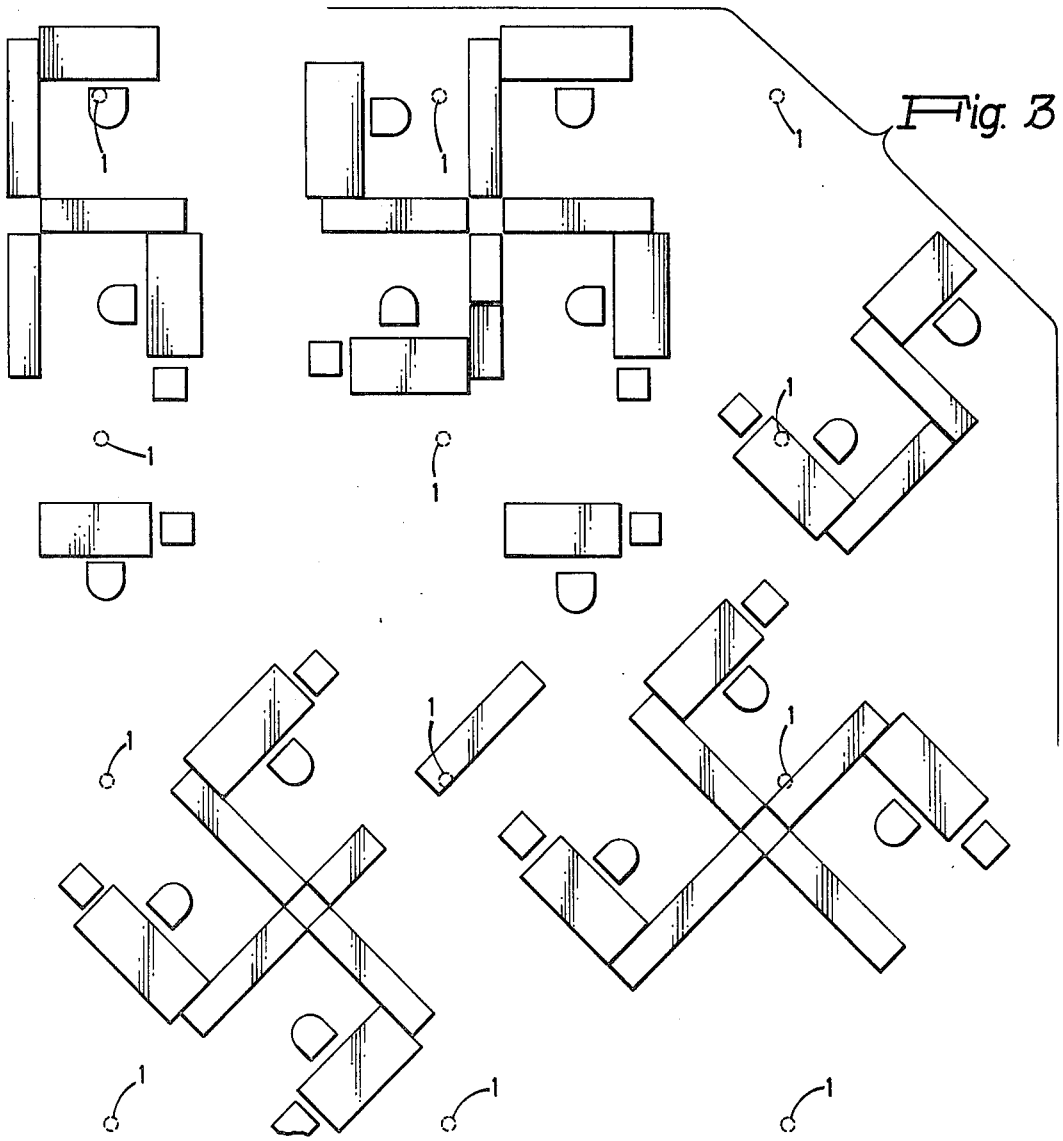
FIG. 3 is a plan vew, with the false ceiling removed, of a typical distribution of masking generators above an acoustical ceiling of an open-plan office.

By distributing the plurality of units 1 at appropriate laterally separated positions in the space between the main and false ceiling surfaces 3 and 3′, as shown, for example, in FIG. 3, and adjusting the unit heights above the sound-diffusing false ceiling surface 3′ for appropriate frequency tailoring or shaping and diffusion, can be effected for the frequency-dependent acoustical power output of the loudspeaker transducer and associated enclosure, for the frequency dependent acoustical noise reduction of the ceiling assembly, and for the frequency-dependent contribution of acoustical power from adjacent generator units 1. Additional frequency shaping is employed to limit displacement of the loudspeaker transducer diaphragm at frequencies less than some lower frequency, and for frequencies greater than some higher frequency necessary for effective speech masking, such as of the before-mentioned values. By selecting and/or changing appropriate false acoustic ceiling tiles or panels 3′, of different porosity or other properties, or providing metal or other diffuser baffle structures including fluorescent or other light diffusing structures, tailoring or shaping of diffusion and spreading characteristics can be attained.

In a typical installation of the type shown in FIG. 3, the units 1 were spaced in rows and columns about 12 feet apart, and suspended within a ceiling space (between 3 and 3′) about 2½ feet high, with an acoustical suspended ceiling 3′ composed of glass fiber and about 2 inches thick. This ceiling 3′, to some extent modified the frequency tailoring of the unit filters 6, introducing attenuation adjustment of the order of 3 db for frequencies of the order of 1 KHz, 7 db for frequencies of the order of 3 KHz, and diffusing the sound radiated from the speaker 12 of the unit 1 about 90° compared with the radiation angle of about 60° generated by the speaker 12. A uniform delocalized cumulative masking noise distribution of substantially the following spectrum shaping was effected over an open space of about 188 square feet: 250 Hz, 47db; 500 Hz, 43db; 1 KHz, 37db; 2 KHz, 32db; 4 KHz, 26db; and 8 KHz, 18db.

The multiplicity of self-contained electronic generators 1 of the invention thus admirably avoids the annoying acoustical interference effects caused by phase coherent spatially adjacent radiators of the prior art. These effects are particularly objectionable in spaces with little or no acoustically incoherent reverberant field which would be capable of minimizing the spatial pressure variations due to coherent radiators. Since large open plan offices typically employ massive amounts of sound absorbent material in order to provide the maximum amount of attenuation of speech sounds with distance from the talker, with a resulting insignificantly small reverberant field, the coherent radiators of the prior art are consequently particularly subject to these deleterious effects in normal open plan applications, which the present invention thus obviates.

As before indicated, moreover, prior art electronic systems require interconnection of loudspeaker transducers and central generation and amplification equipment via a complex power distribution network, with installation normally accounting for the greater part of total system cost. The self-contained units 1 of the invention, on the other hand, require only connection to commonly available AC power in the above-ceiling space.

Failure of a single discrete component in the generator, frequency shaping equipment, power amplifier, or distribution network of a conventional system, moreover, may result in total system failure; whereas failure of an entire self-contained generator 1 of the invention would have minimal effect on total system performance. Small changes in output level or spectrum shape of an individual self-contained generator 1 of the invention would also have minimal effect on total system performance; whereas the total power and spectral output of a system operated from a common generator, as in the prior art is affected to the same degree as the change in generator output.

Figure 1A:
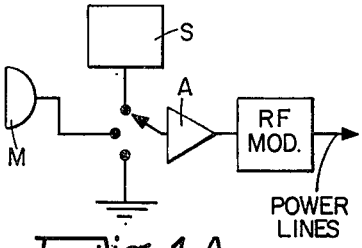

The unitary nature and constructional and mounting features of the self-contained generators 1, moreover, admirably lends itself to the optional superposition of speech, music or other coherent intelligence signals, as from a transmitter, FIG. 1A, coupling a radio-frequency carrier modulated by such signals to the power lines. A microphone M or music source S may selectively be connected, when desired, through an amplifier A to a radio-frequency carrier oscillator-modulator, labelled "RFMod" which is transformer coupled to the power lines. At the unit 1, FIG. 1, a demodulator or detector DET may similarly optionally be coupled to the power line at T, with the resulting demodulated intelligence signal superimposed on the noise signals by an adder interposed after the noise source 4.

The present invention thus provides significant improvement in speech privacy, particularly in open space structures, which can also, however, be attained in varying degrees of efficacy in other applications of the invention wherein such improvements are desired, as in separate partitioned rooms with wall mounting positions. As another example, the background noise with an appropriately tailored frequency spectrum can itself be provided to speaker units by connecting several incoherent sound sources of the type described to the radio-frequency carrier oscillator-modulator before described, again transformer-coupled to the power lines as in FIG. 1. Further modifications will also occur to those skilled in this art, and such are considered to fall within the spirit and scope of the invention as defined in the appended claims.

What is claimed is:

1. A process of distributing masking sound in an open-plan space and the like, that comprises, independently and incoherently generating and radiating noise at a plurality of positions laterally separated from one another above a sound-transmitting surface covering such an open space; shaping the frequency spectrum of the noise to correspond substantially to that desired for speech privacy masking; and adjusting the lateral separation of noise radiation positions from one another to control the diffusion and distribution of the masking noise sound cumulatively transmitted through and below said surface into the open space, in order to provide a uniform, de-localized incoherent masking radiation within said open space.

2. A process as claimed in claim 1 and in which intelligence signal radiation is superimposed upon said incoherent masking noise radiation.

3. Apparatus for distributing masking noise through a false ceiling surface and the like into an open space therebelow, having, in combination, a plurality of independent incoherent noise-generating units, each provided with a separate electronic noise source, frequencing shaping filter, amplifying and sound radiating means; means for mounting said units at a plurality of positions laterally spaced over the ceiling surface; means for powering said units from ceiling power conduit means; and means for tuning the shaping filter and for adjusting the height of said units above said ceiling surface and adjusting the lateral separation of said units to provide a predetermined speech privacy noise attenuation spectrum below said ceiling surface, said surface being selected to diffuse the noise radiated from the plurality of units to provide cumulative de-localized incoherent masking radiation within said open space.

4. Apparatus as claimed in claim 3 and in which said tuning and adjusting means are adjusted to provide substantially the following relative levels, measured in octave bands: 125 Hz-0db; 250 Hz-3db; 500 Hz-6db; 1000 Hz-11db; 2000 Hz-18db; 4000 Hz-26db; 8000 Hz-36db.

5. Apparatus as claimed in claim 3 and in which means is provided for receiving and demodulating radio-frequency carried intelligence signals and adding the same to the incoherent masking noise from said electronic noise source to radiate with the noise from said sound radiating means.

6. Apparatus as claimed in claim 5 and in which means is provided for carrying said intelligence signals along said power conduit means, and said receiving and demodulating means is coupled to said power conduit means.

7. Apparatus for distributing masking noise into an open space, having, in combination, a plurality of independent incoherent noise-generating units, each provided with a separate electronic noise source, frequencing shaping filter, amplifying and sound radiating means; means for mounting said units at a plurality of positions laterally spaced from one another; means for powering said units from power conduit means associated with said space; and means for tuning the shaping filter and for adjusting the height and the lateral separation of said units to provide a predetermined speech privacy noise attenuation spectrum within said space, and to provide incoherent masking radiation there within.

8. Apparatus as claimed in claim 7 and in which said tuning and adjusting means are adjusted to provide substantially the following relative levels, measured in octave bands: 125 Hz-0db; 250 Hz-3db; 500 Hz-6db; 1000 Hz-11db; 2000 Hz-18db; 4000 Hz-26db; 8000 Hz-36db.

9. Apparatus as claimed in claim 7 and in which means is provided for receiving and demodulating radio-frequency carried intelligence signals and adding the same to the incoherent masking noise from said electronic noise source to radiate with the noise from said sound radiating means.

10. Apparatus as claimed in claim 9 and in which means is provided for carrying said intelligence signals along said power conduit means, and said receiving and demodulating means is coupled to said power conduit means.

11. Apparatus as claimed in claim 3 and in which diffusing and frequency-spreading means is provided below said units.

12. A process as claimed in claim 1 in which said positions are laterally separated from one another in two dimensions and are two-dimensionally distributed over substantially the entire area of a sound-diffusing surface covering an open-plan space having an insignificantly small reverberant field, in which the noise generated at each position is free of cyclic correspondence to the noise generated at any other position and in which the noise generated at any instant at any position is unrelated to the noise then generated at the other positions.

13. Apparatus as claimed in claim 3 in which said positions are laterally separated from one another in two dimensions and are two-dimensionally distributed over substantially the entire area of a sound-diffusing ceiling surface, in which said noise-generating units generate noise at each position free of cyclic correspondence to the noise generated at any other position, and in which the noise generated at any instant at any position is unrelated to the noise then generated at the other positions, in order to provide a uniform, delocalized incoherent masking radiation throughout said space.

14. Apparatus as claimed in claim 7 in which said positions are laterally separated from one another in two dimensions and are two-dimensionally distributed over substantially the entire area of a sound-diffusing ceiling covering said open space, in which each of said noise-generating units generates noise free of any cyclic correspondence to the noise generated by any other noise generating unit, and in which the noise generated at any instant by any unit is unrelated to the noise then generated by the other units, in order to provide a uniform, delocalized incoherent masking radiation throughout said space.

* * * * *